US005725310A

United States Patent [19]

Kruczko

[11] Patent Number: 5,725,310

[45] Date of Patent: Mar. 10, 1998

[54] DISPOSABLE ARTICLE RECEIVING DEVICE

[75] Inventor: Serge Mark Kruczko, Jamaica, N.Y.

[73] Assignee: J & H Kuntz Enterprises, Ltd.

[21] Appl. No.: 707,215

[22] Filed: Sep. 3, 1996

[51] Int. Cl.[6] ..... B65D 30/20

[52] U.S. Cl. ..... 383/11; 229/117.05; 383/86; 383/86.2; 493/183

[58] Field of Search ..... 383/11, 86.1, 86.2, 383/86; 229/117.05, 117.06, 183, 132; 493/183

[56] References Cited

U.S. PATENT DOCUMENTS

| | | | |
|---|---|---|---|
| 308,418 | 11/1884 | Lockwood | 383/86 |
| 447,103 | 2/1891 | Cussen | 383/86 |
| 661,767 | 11/1900 | O'Brien | 229/117.05 |
| 1,589,118 | 6/1926 | Cowen | 383/86 |
| 1,824,508 | 9/1931 | Shipman | 383/86 |
| 1,866,241 | 7/1932 | Vineberg | 383/86 |
| 1,974,630 | 1/1934 | Sessler | 220/63 |
| 1,988,939 | 1/1935 | Craig | 206/57 |
| 2,329,444 | 9/1943 | Snyder | 383/86 |
| 2,345,309 | 3/1944 | Wensel | 206/57 |
| 2,529,724 | 11/1950 | Conwiser | 383/85 |
| 2,631,772 | 3/1953 | Hiersteiner | 229/117.06 |
| 2,796,309 | 1/1957 | Taylor | 312/211 |
| 3,327,928 | 6/1967 | Green | 383/86 |
| 3,333,686 | 8/1967 | Schnabel | 206/47 |
| 3,374,508 | 3/1968 | Slimovitz | 383/11 |
| 3,510,052 | 5/1970 | Ruda | 383/11 |
| 3,693,192 | 9/1972 | Knotts | 383/86 |
| 3,817,445 | 6/1974 | Greason | 229/70 |
| 3,836,037 | 9/1974 | Bass | 220/35 |
| 3,960,269 | 6/1976 | Jenkins | 206/233 |
| 4,139,037 | 2/1979 | McGuigan | 383/11 |
| 4,194,624 | 3/1980 | Spiegelberg | 206/441 |
| 4,221,161 | 9/1980 | Hurt | 93/1 R |
| 4,236,460 | 12/1980 | Poupko | 108/41 |
| 4,444,343 | 4/1984 | Perlsweig | 224/276 |
| 4,483,440 | 11/1984 | Ware | 206/233 |
| 4,580,685 | 4/1986 | Jorquez | 211/56 |
| 4,630,312 | 12/1986 | Milstein | 383/86 |
| 4,738,390 | 4/1988 | Brennan | 229/77 |
| 4,815,480 | 3/1989 | Martin | 128/879 |
| 4,836,440 | 6/1989 | French | 493/183 |
| 4,860,386 | 8/1989 | Martin | 2/243 R |
| 4,919,302 | 4/1990 | McPherson | 221/34 |
| 4,992,128 | 2/1991 | Sellar et al. | 156/217 |
| 5,000,327 | 3/1991 | Kincheloe | 211/88 |
| 5,195,683 | 3/1993 | Gaetano | 229/72 |
| 5,314,232 | 5/1994 | Hopkins | 383/40 |
| 5,332,093 | 7/1994 | Littlepage | 206/457 |
| 5,383,727 | 1/1995 | Rife | 383/11 |

FOREIGN PATENT DOCUMENTS

| | | | |
|---|---|---|---|
| 471329 | 2/1951 | Canada | 229/132 |
| 2250975 | 6/1992 | United Kingdom | 383/11 |

*Primary Examiner*—Stephen P. Garbe

*Attorney, Agent, or Firm*—Porter, Wright, Morris & Arthur

[57] ABSTRACT

A disposable article receiving device for use for disposing of chewed gum and other small articles and method of constructing said device, the article receiving device comprising an envelope body having a front panel, two side panels, a bottom panel, and a rear panel, a cover flap being attached to the rear panel, means for removably attaching the cover flap to the front panel of the envelope body for closing the article receiving device, and means for removably attaching the article receiving device to a suitable surface, the article receiving device being movable from an unexpanded storage position to an expanded used position.

15 Claims, 4 Drawing Sheets

DISPOSABLE ARTICLE RECEIVING DEVICE

This invention relates to an article receiving device and, more particularly, to a disposable article receiving device which is particularly adapted to receive chewed gum and other small, hard-to-dispose-of articles.

BACKGROUND OF THE INVENTION

Industry, and in particular the transportation industry, has been plagued by the problem of removing and disposing of chewed gum from the back and under sides of chairs, tables, ashtrays, etc., places where patrons of such transportation services commonly dispose of their used chewing gum. Because of its sticky nature, even placing the used chewing gum in an ashtray or other waste container presents the problem of cleaning out the waste container or ashtray.

One attempt to solve the problem of dispensing with chewed gum is described in U.S. Pat. No. 3,960,269 to Jenkins. The '269 patent discloses a combination ash tray and chewed gum disposal package. The combination package, as described in the '269 patent, provides a supply of tissues in which chewed gum may be wrapped, and a receptacle into which the wrapped gum may be inserted. The '269 patent depends upon (1) making the packages available wherever gum may be chewed, and (2) ensuring that people utilize the tissue papers for disposing of their chewed gum. Also, because the invention described in the '269 patent is expensive and impractical to install at every location where chewing gum would be disposed of, it is unlikely that the device will be widely used. Another disadvantage of the 3 269 device is that its size makes it bulky and unsightly and, therefore, less likely to be installed on, for example, the back of every chair on a passenger train or plane.

It is, therefore, an object of the instant invention to provide a receptacle for small articles, in particular, chewed gum that is inexpensive to manufacture.

It is also an object of the invention to provide an article receiving device which is disposable.

It is further an object of the instant invention to provide an article receiving device which would be installed easily and conveniently at any desirable location, thereby ensuring that the receptacle is used to the maximum extent possible.

SUMMARY OF THE INVENTION

The present invention is directed towards an inexpensive, disposable receptacle for receiving small articles, for example, chewed gum.

In an illustrative embodiment of the invention, a small article receiving device having an accordion envelope body and a cover flap is releasably fastened to a suitable surface. The suitable surface may be the back of a chair or along an arm rest in, for example, a plane or a bus. The article receiving device is constructed as a continuous web, with each panel being shaped to allow for quick assembly. When fully assembled and folded into its unexpanded position, the article receiving device lies neatly against the back of a seat or along an arm rest, with the cover flap inserted under a receiving band.

In its expanded position, when the article receiving device is in use, the cover flap unfolds to completely cover the envelope body, the forward edge of the cover flap being fastened to the envelope body by any suitable fastening means. The accordion envelope, having one or more folds may be releasably fastened to the back of the chair or arm rest by using Velcro® strips or patches, or by using other suitable means like a clip which is insertable into a sleeve or band. It is desirable, however, that a cleaning crew be able to remove a used envelope and to replace it with a new envelope, quickly and efficiently.

A method for constructing the article receiving device is also disclosed. The article receiving device is constructed from a single sheet of suitable material, for example, a spun-bonded olefin produced by DuPont under the trade name "Tyvek®." The single sheet of material is cut to the desired shape as described in the invention. The folds within the single sheet describe separate sections as follows: a rear panel having an adhesive flap attached to the bottom edge thereof, and having a cover flap attached to the top edge thereof; a front panel, also having an adhesive flap attached to the bottom edge thereof; a first side panel attached to one side of the rear panel and having an adhesive flap attached to its other side, and further having a bottom section attached to the bottom edge of the first side panel; and a second side panel attached on one side to the other side of the rear panel and attached on its other side to the front panel, and also having a bottom section attached to the bottom edge of the second side panel. The cover flap is further divided into a front flap section, a rear flap section, and wing flap sections running along the sides of the front and rear flap sections.

The article receiving device is preferably assembled by folding the two side panels upwards. Next, the first adhesive flap is folded inwards and the front panel is folded down and adhered to the first adhesive flap. Next, the sections attached to the bottom edge of the side panels are folded inwards to form the bottom panel. The second and third adhesive flaps on the front and rear panels, respectively, are then folded on top of, and adhered to, the bottom panel. The cover is than used to cover the article receiving device, and is releasably fastened to the front panel of the envelope body, by any suitable means.

In use, chewed gum and other hard-to-dispose-of articles are inserted into the article receiving device, and the cover flap is closed. The used envelope may then be disposed of by removing the entire envelope from the back of the chair or from the arm rest. A new envelope is quickly attached to the chair or arm rest in place of the old envelope.

BRIEF DESCRIPTION OF THE DRAWINGS

The foregoing and other features of the present invention will be more readily apparent from the following detailed description and drawings of an illustrative embodiment of the article receiving device in which.

DESCRIPTION OF AN ILLUSTRATIVE EMBODIMENT

Figure 1:
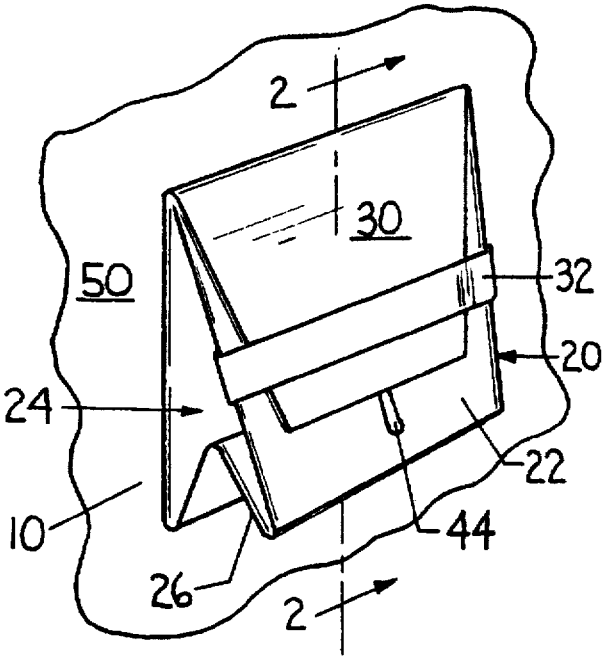
FIG. 1 is a perspective view of an illustrative embodiment of the invention, as shown in the unexpanded or unused configuration.
Figure 2:
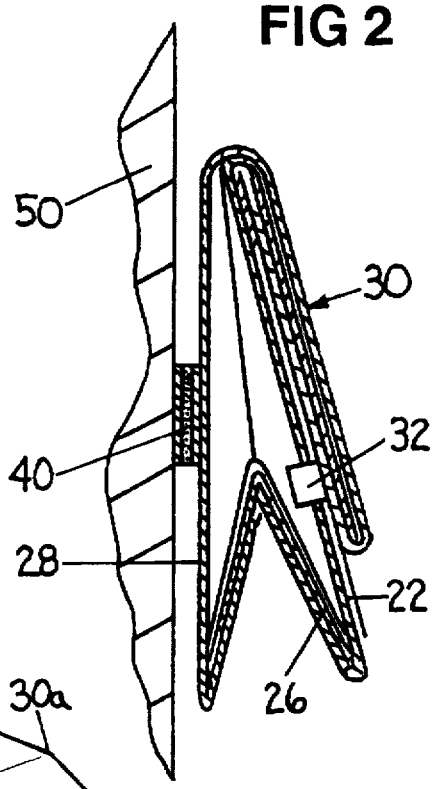
FIG. 2 is a cross-sectional view taken along section 2—2 of FIG. 1.

FIGS. 1 and 2 illustrate a preferred embodiment of the invention in which an article receiving device 10 comprising a small accordion envelope body 20 having a front panel 22, side panels 24, a bottom panel 26, and a rear panel 28, a cover flap 30 to cover the envelope body 20, means for attaching the cover flap 30 to the front panel 22 of the envelope body 20, and means 40 for attaching the envelope body 20 to a suitable surface 50, for example, the back of a chair or an armrest, is described. FIG. 1 illustrates the envelope body 20 with the cover flap 30 in the unexpanded position. As shown in FIG. 1, the cover flap 30 is placed under a receiving band 32, the receiving band 32 being attached across the front panel 22 of the envelope body 20. In the unexpanded position, the bottom panel 26 of the envelope body 20 is folded upwards and the side panels 24 are both folded inwards, thereby allowing the envelope body 20 to collapse into the unexpanded position. This allows the article receiving device 10 to be placed unobtrusively on the back of a seat or chair or on an arm rest. Although the accordian envelope body 20 is described having one fold in the side panels 24, any number of folds may be used, depending on the intended use for the article receiving device 10.

FIG. 2 is a cross-sectional view taken along section 2—2 of FIG. 1. FIG. 2 clearly illustrates attachment means for attaching the rear panel 28 of the envelope body 20 to the hard surface 50. Any suitable means is envisioned, provided that the envelope body 20 is readily detached from the hard surface 50. Examples of suitable attachment means include Velcro® strips or patches, hook attachment means, and adhesive means.

Figure 3:
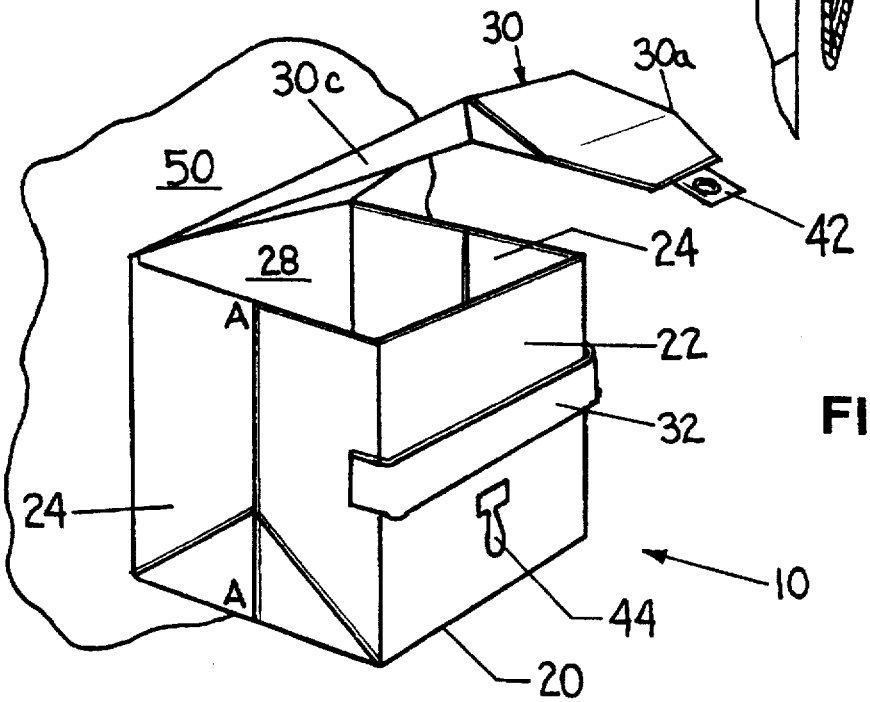
FIG. 3 is a perspective view of the illustrative embodiment of the invention, as shown in the expanded configuration with the cover flap unattached.
Figure 5:
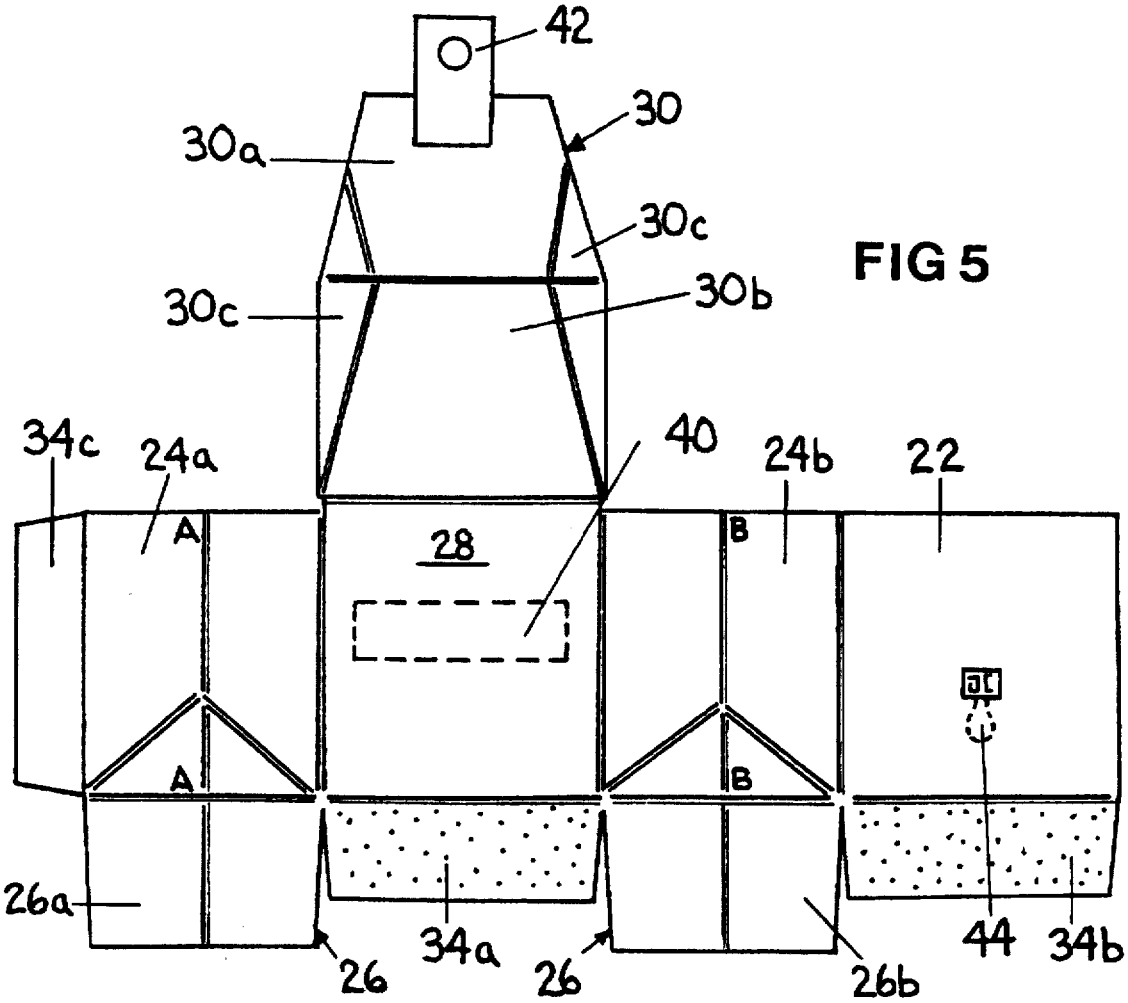
FIG. 5 is a top plan view of a flat sheet of material which has been cut according to the method of the invention for forming the article receiving device.

FIG. 3 illustrates the article receiving device 10 in the expanded position. As shown in FIG. 3, the side panels 24 and the bottom panel 26 of the envelope body 20 are all unfolded, thereby opening up the envelope body 20 to its expanded position. The cover flap 30 is also shown in the unfolded position. Referring to FIGS. 3 and 5, the cover flap 30 is divided into four flap sections: a front flap section 30*a*, a rear flap section 30*b*, and two wing flap sections 30*c* along each side of the front and rear flap sections (30*a* and 30*b*). In the folded position illustrated by FIGS. 1 and 2, the wing flap sections 30*c* are folded in between the front and rear flap sections, 30*a* and 30*b*, respectively, and then the front flap section 30*a* is folded underneath the rear flap section 30*b*. This allows for forward tapering of the cover flap 30, for easy insertion under the receiving band 32, when the cover flap 30 is in the folded position. FIG. 3 shows the wing flap sections 30*c* and the front flap section 30*a* in the unfolded position.

Figure 4:
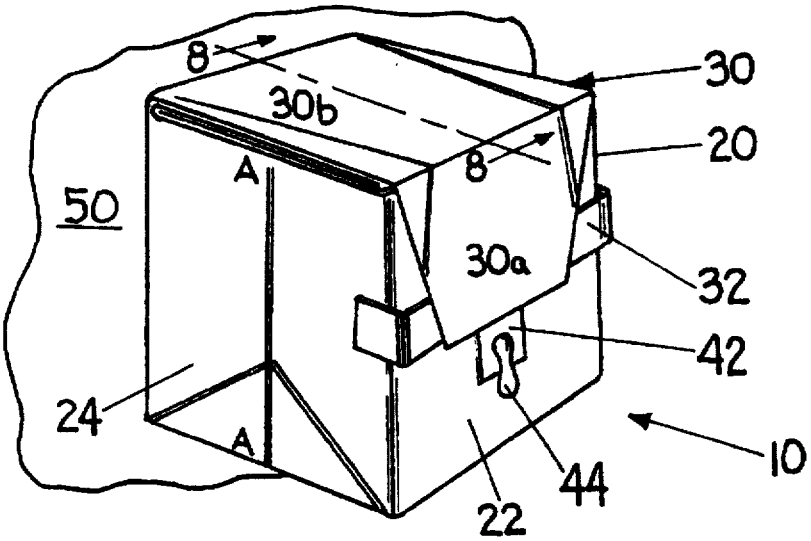
FIG. 4 illustrates the article receiving device according to the invention in the expanded configuration having the cover flap attached.

Also shown in FIG. 3 is an attachment eye 42 and a hook 44. This attachment eye 42 is attached to the front flap section 30*a*. The hook 44 is correspondingly attached to the front panel 22 of the envelope body 20. In the unfolded position, the cover flap 30 completely covers the article receiving device 10 when the device 10 is placed in the expanded position, for example, after use. This is shown by FIG. 4. Although a hook and attachment eye arrangement is shown for closing the article receiving device 10, any other suitable closing means may be used, for example, Velcro® strips and/or patches may be used.

Figure 6:
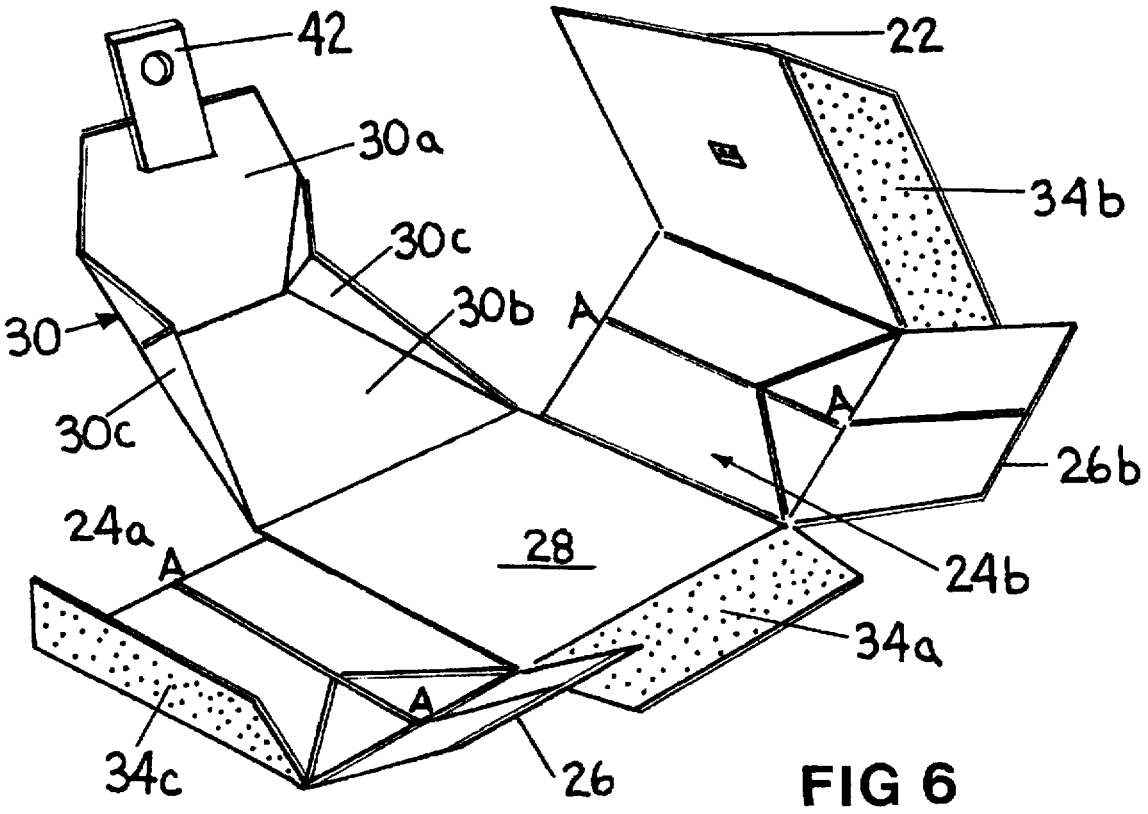
FIG. 6 illustrates the initial steps in folding the flat sheet to form the article receiving device.
Figure 7:
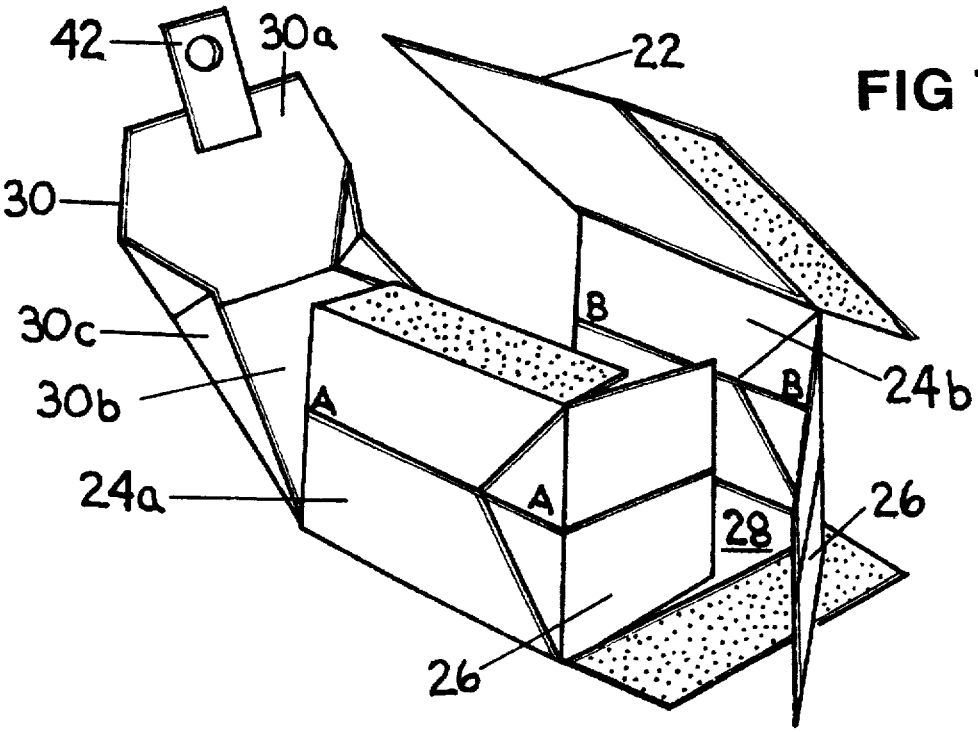
FIG. 7 illustrates an advanced step in folding the flat sheet to form the article receiving device.

FIGS. 5–7 illustrate a preferred method for constructing the article receiving device 10. According to the invention, the article receiving device 10 is made from a single sheet of material which is cut into the desired pattern. The folds within the shingle sheet describe separate sections as follows: a rear panel 28 having an adhesive flap 34*a* attached to the bottom edge thereof, and having a cover flap 30 attached to the top edge thereof; a front panel 22, also having an adhesive flap 34*b* attached to the bottom edge thereof; a first side panel 24*a* (the left side panel as shown in FIG. 5) attached to one side of the rear panel 28 and having an adhesive flap 34*c* attached to its other side, and further having a bottom section 26*a* attached to the bottom edge of the first side panel 24*a*; and a second side panel 24*b* attached on one side to the other side of the rear panel 28 and attached on the other side to the front panel 22, and also having a bottom section 26*b* attached to the bottom edge of the second side panel 24*b*. As described above, the cover flap 30 is further divided into the front flap section 30*a*, the rear flap section 30*b*, and wing flap sections 30*c* running along the sides of the front and rear flap sections (30*a* and 30*b*, respectively).

As shown in FIGS. 6 and 7, the envelope body 20 is first assembled by folding the two side panels (26*a* and 24*b*) upwards. Next, the adhesive flap 34*c* , attached to the side panel 26*a*, is folded inwards and the front panel 22 is folded down and adhered to the adhesive flap 34*c*. Next, the bottom sections, 26*b* and 26*b*, are folded inwards to form the bottom panel 26. The adhesive flaps 34*a* and 34*b*, on the front and rear panels 22 and 28, respectively, are then folded on top of, and adhered to, the bottom panel 26. This serves to reinforce the bottom panel 26. Although the bottom panel 26 is preferably made from the two bottom sections 26*b* and 26*b*, respectively, it is also envisioned that the bottom panel 26 may be constructed from a single section attached to the bottom edge of either side panel 26*a* or 24*b*.

The attachment eye 42 is attached to the forward edge of the front flap section 30*a*. The hook 44 is attached to the front panel 22 of the envelope body 20 at a location corresponding to the attachment eye 42. In its expanded form, the article receiving device 10 may be closed by fastening the attachment eye 42 over the hook 44. Numerous other suitable fastening means are also envisioned, for example, using Velcro® to fasten the cover flap 30 to the front panel 22.

Figure 9:
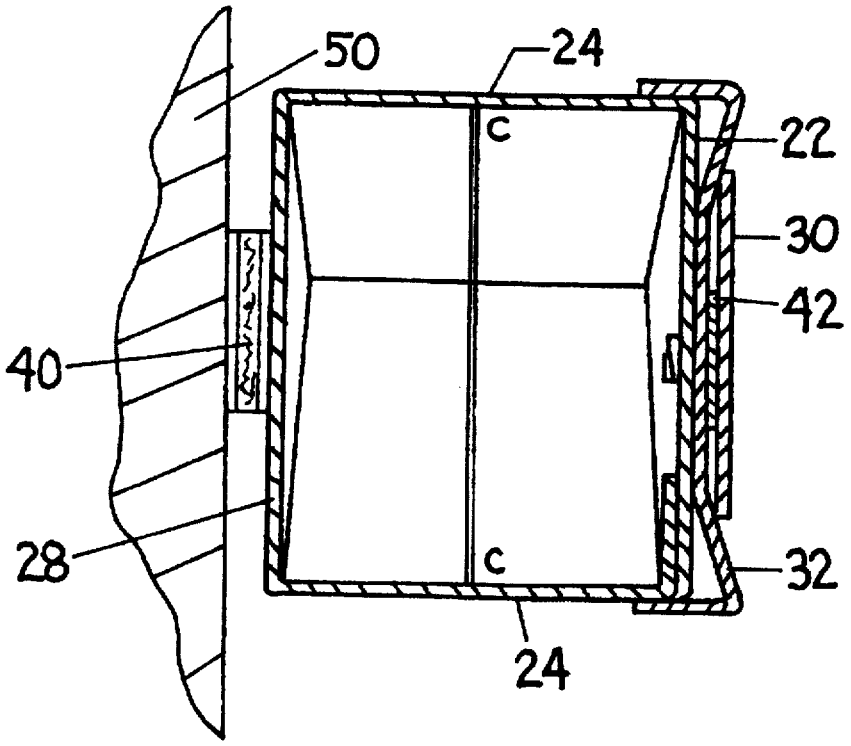
FIG. 9 is a cross-sectional view taken along section 9—9 of FIG. 8.

In order to place the article receiving device 10 in its unexpanded position with the cover flap 30 closed, (1) the side panels 26*a* and 24*b* are folded inwards along lines A—A and B—B, respectively; (2) the bottom panel 26 is folded upwards along line C—C (FIG. 9); (3) the wing flap sections 30*c* of the cover flap 30 are folded inwards; (4) the front flap section 30*a* is folded underneath the rear flap section 30*b*; and (5) the folded cover flap 30 is inserted under the receiving band 32. Here again, other closing means may be used, for example, a Velcro® strip may be placed along the cover flap 30 to close the flap 30 when the article receiving device 10 is in the unexpanded position.

Figure 8:
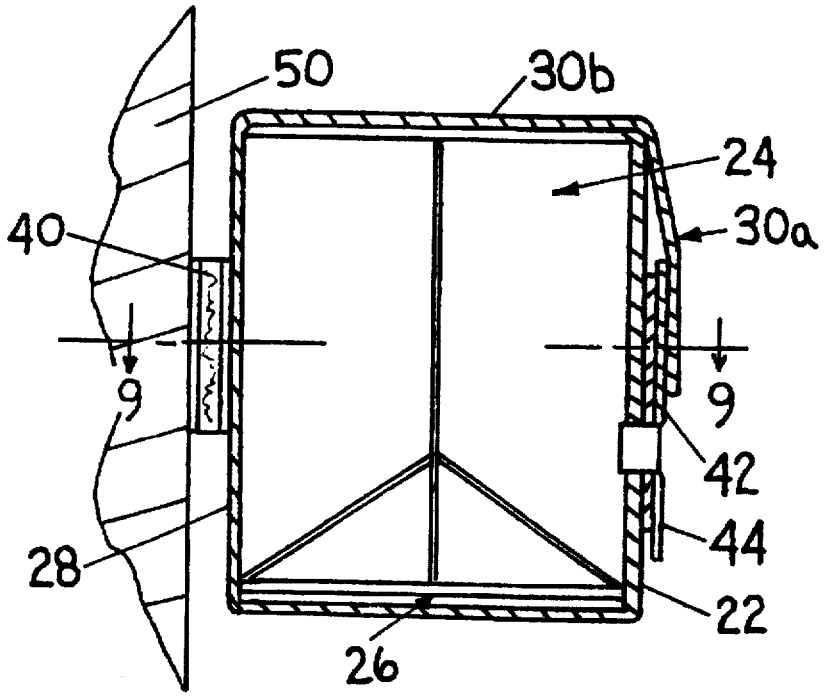
FIG. 8 is a cross-sectional view taken along section 8—8 of FIG. 4.

FIG. 8 is a cross-sectional view taken along section 8—8 of FIG. 4 and illustrates the expanded article receiving device 10 with the unfolded cover flap 30 completely covering the envelope body 20. As shown, the attachment eye 42 is in place over the hook 44. FIG. 9 is a cross-sectional view taken along section 9—9 of FIG. 8.

In the preferred embodiment of the invention, the article receiving device 10 is used for receiving chewed gum and other small hard-to-dispose-of objects. In this application, the article receiving device 10 is preferably located in places where people are typically known to chew gum and, therefore, would have to dispose of their chewed gum. For example, the article receiving device 10 may be placed on cars, buses, passenger trains, ferries, planes and other forms of public and private transportation, and also at stadiums, in conference rooms and in rest rooms. To facilitate receiving chewed gum, the accordion envelope 10 is preferably made from a spun-bonded olefin material, such material being available from DuPont under the trade name "Tyvek®." Other suitable materials may also be used, for example, a waxed paper. However, since the article receiving device 10 is designed to be disposed of after use, the only requirement is that the material be sufficiently durable to withstand disintegration until the envelope is collected and disposed of. In situations where cigarette butts may be disposed of inside the article receiving device 10, it is desirable that a flame retardant material be used, or else that the article receiving device 10 be treated with a flame retardant substance.

Although the invention is described with reference to chewed gum, it is understood that the article receiving device 10 may be used for receiving any small object. In other applications, for example, in hospitals, where wet articles are deposited into the article receiving container, water resistant or water proof materials may be used. For example, a rubberized or a plastic material may be most suitable for hospital applications. Also, a thin aluminum foil or other flexible metallic material may be used for added strength and durability.

While the invention has been particularly shown and described with reference to illustrative embodiments thereof, it will be understood by those skilled in the art that various changes in form and details may be made therein without departing from the spirit and scope of the invention.

I claim:

1. A disposable article receiving device which is expandable between a storage position and a use position, the disposable article receiving device comprising:

an envelope body having a front panel, two side panels, a bottom panel, and a rear panel;

a cover flap to cover the envelope body, the cover flap being divided into a front flap section, a rear flap section, and two wing flap sections along each side of the front and rear flap sections, the wing flap sections having fold lines for folding the wing flap section underneath the front and rear flap sections;

means for releasably attaching the cover flap to the front panel of the envelope body; and means for removably attaching the article receiving device to a suitable surface, wherein (1) the two side panels have fold lines located thereon for placing each side panel into the storage position, (2) the wing flap sections of the cover flap are folded underneath the front and rear flap sections, and (3) a receiving band is attached across the front panel for receiving the cover flap when the article receiving device is in the storage position.

2. The disposable article receiving device as in claim 1 wherein the front flap section is folded underneath the rear flap section, to form a folded cover flap, the folded cover flap being insertable underneath the receiving band for closing the article receiving device when in the storage position.

3. The disposable article receiving device as in claim 1 wherein the means for removably attaching the cover flap to the front panel of the envelope body, comprise:

a strip having a thistle portion thereon attached to the front panel of the envelope body; and a corresponding strip having a hook portion thereon attached to the cover flap, the hook portion being releasably engageable with the thistle portion.

4. The disposable article receiving device as in claim 1 wherein the means for removably attaching the cover flap to the front panel of the envelope body comprise:

a hook attached to the front panel of the envelope body; and an eye attached to the front flap section of the cover flap, the hook being removably attachable to the eye.

5. The disposable article receiving device as in claim 1 wherein the means for removably attaching the article receiving device to a suitable surface, comprise:

a strip having a thistle portion thereon attached to a suitable surface; and a corresponding strip having a hook portion thereon attached to the rear panel of the envelope body, the hook portion being releasably engageable with the thistle portion.

6. The disposable article receiving device as in claim 1 wherein the means for removably attaching the article receiving device to a suitable surface, comprise:

a flat clip hook attached to the rear panel of the envelope body, and a clip receiving band attached to a suitable surface, the flat clip hook being removably attachable to the clip receiving band.

7. A chewed gum receptacle which is expandable between a storage position and a use position, the chewed gum receptacle comprising:

an envelope body having a front panel, two side panels, a bottom panel, and a rear panel;

a cover flap to cover the envelope body, the cover flap having a front flap section, a rear flap section, and two wing flap sections along each side of the front and rear flap sections, the wing flap sections having fold lines for folding the wing flap section underneath the front and rear flap sections;

means for removably attaching the cover flap to the front panel of the envelope body; and means for removably attaching the chewed gum receptacle to a suitable surface, wherein (1) the two side panels have fold lines located thereon for placing each side panel into the storage position, and (2) the envelope body and the cover flap are made from a waxed paper material.

8. The chewed gum receptacle as in claim 7 wherein, (1) the wing flap sections are folded underneath the front and rear flap sections, and (2) the front flap section is folded underneath the rear flap section, to form a folded cover flap, the folded cover flap being releasably attachable to the envelope body of the chewed gum receptacle.

9. The chewed gum receptacle as in claim 8 further comprising a receiving band attached to the front panel of the envelope body, for receiving the folded cover flap.

10. The chewed gum receptacle as in claim 8 wherein the means for removably attaching the cover flap to the front panel of the envelope body, comprise:

a strip having a thistle portion thereon attached to the front panel of the envelope body; and a corresponding strip having a hook portion thereon attached to the cover flap, the hook portion being releasably engageable with the thistle portion.

11. The chewed gum receptacle as in claim 8 wherein the means for removably attaching the cover flap to the front panel of the envelope body, comprise:

a hook attached to the front panel of the envelope body; and an eye attached to the front flap section of the cover flap, the hook being removably attachable to the eye.

12. The chewed gum receptacle as in claim 7 wherein the means for removably attaching the chewed gum receptacle to a suitable surface comprise:

a strip having a thistle portion thereon attached to a suitable surface; and a corresponding strip having a hook portion thereon attached to the rear panel of the envelope body, the hook portion being releasably engageable with the thistle portion.

13. The chewed gum receptacle as in claim 7 wherein the means for removably attaching the chewed gum receptacle to a suitable surface, comprise:

a flat clip hook attached to the rear panel of the envelope body, and a clip receiving band attached to a suitable surface, the flat clip hook being removably attachable to the clip receiving band.

14. A method of making a disposable article receiving device which is expandable between a storage position and a use position, comprising the steps of:

cutting a single sheet of material into a desired pattern, the desired pattern comprising:

a rear panel having a top edge, a bottom edge, a first side edge, and a second side edge, the rear panel further having an adhesive flap attached to the bottom edge thereof;

a cover flap attached to the top edge of the rear panel, the cover flap having a front flap section, a rear flap section, and wing flap sections running along the sides of the front and rear flap sections;

a front panel having a bottom edge, the front panel having an adhesive flap attached to the bottom edge thereof;

a first side panel having a centrally located fold line, two side edges, a top edge and a bottom edge, the first side panel being attached at one side edge to the first side edge of the rear panel, the first side panel further having an adhesive flap attached to the other side edge, the first side panel further having a bottom section attached to the bottom edge of the first side panel;

a second side panel having a centrally located fold line, two side edges, a top edge and a bottom edge, the second side panel being attached on one side to the second side of the rear panel and attached on the other side to the front panel, the second side panel also having a bottom section attached to the bottom edge thereof;

folding the two side panels upwards;

folding the adhesive flap attached to the first side panel inwards;

folding the front panel downwards and adhering the front panel to the adhesive flap attached to the first side panel;

folding the bottom sections attached to the first and second side panels laterally, thereby forming a bottom panel;

folding the adhesive flaps attached to the front and rear panels on top of the bottom panel and adhering the adhesive flaps thereto, thereby forming an envelope body having the cover flap attached thereto, where, in order to place the article receiving device in the storage position, (1) the side panels are folded inwards along the centrally located fold line;

(2) the bottom panel is folded upwards, also along a centrally located fold line, to fully collapse the envelope body;

(3) the wing flap sections of the cover flap are folded underneath the front and rear flap sections of the cover flap; and (4) the front flap section is folded underneath the rear flap section, thereby forming a folded cover flap.

15. The method of making a disposable article receiving device which is expandable between a storage position and a use position, as in claim 14, further comprising the step of releasably attaching the folded cover flap to the front panel of the envelope body.

* * * * *